US007108238B2

(12) United States Patent
Gauci

(10) Patent No.: US 7,108,238 B2
(45) Date of Patent: Sep. 19, 2006

(54) OUTDOOR LIGHT MOUNTING BRACKET

(75) Inventor: Jason Gauci, Greensboro, NC (US)

(73) Assignee: Regent Lighting Corporation, Peachtree City, GA (US)

( * ) Notice: Subject to any disclaimer, the term of this patent is extended or adjusted under 35 U.S.C. 154(b) by 18 days.

(21) Appl. No.: 09/912,206

(22) Filed: Jul. 24, 2001

(65) Prior Publication Data

US 2001/0048056 A1 Dec. 6, 2001

Related U.S. Application Data

(63) Continuation of application No. 09/320,257, filed on May 26, 1999, now abandoned.

(51) Int. Cl.
*A47B 96/00* (2006.01)

(52) U.S. Cl. ..... 248/221.11; 248/222.51; 248/343; 362/147

(58) Field of Classification Search ..... 248/220.21, 248/243, 221.11, 222.14, 222.51, 225.21, 248/225.11, 304, 343, 317; 362/432, 147, 362/371

See application file for complete search history.

(56) References Cited

U.S. PATENT DOCUMENTS

RE22,037 E * 2/1942 Markel et al ..... 248/225.11
2,369,336 A * 2/1945 Cable ..... 248/225.21
4,156,272 A * 5/1979 Wandler ..... 362/432
4,199,803 A * 4/1980 Hunt, III ..... 362/263
4,222,093 A * 9/1980 Garcia et al. ..... 362/147
4,303,217 A * 12/1981 Garfinkle ..... 248/221.1
4,368,506 A * 1/1983 Rapp ..... 362/147
4,576,302 A * 3/1986 Smolik ..... 220/3.5
4,726,152 A * 2/1988 Vagedes et al. ..... 52/28
4,824,061 A * 4/1989 Sumikama et al. .... 248/225.21
4,979,713 A * 12/1990 Bell ..... 248/224.3
5,000,409 A * 3/1991 MacLeod et al. ..... 248/205.1
5,275,366 A * 1/1994 Simmons ..... 248/205.1
5,348,268 A * 9/1994 Klein ..... 248/681
5,376,020 A * 12/1994 Jones ..... 439/537
5,549,266 A * 8/1996 Mitchell et al. ..... 248/205.1
5,603,475 A * 2/1997 Lim ..... 248/222.14
5,975,477 A * 11/1999 Spitler ..... 248/342
6,155,701 A * 12/2000 Leen ..... 362/370
6,439,750 B1 * 8/2002 Klaus et al. ..... 362/418

* cited by examiner

*Primary Examiner*—Ramon O Ramirez

(57) ABSTRACT

A light fixture mount capable of securing an outdoor light to a support surface. The device includes a first support that is adapted to co-act with a second support so as to hold the light fixture in a stable and supported position until the light fixture is secured to the support surface in a permanent relationship. This is accomplished by providing on one of the supports at least one catch that engages the opposing support so as to support the weight of the fixture in a stable position while fasteners are installed to secure the fixture to the support surface.

31 Claims, 2 Drawing Sheets

FIG. 3
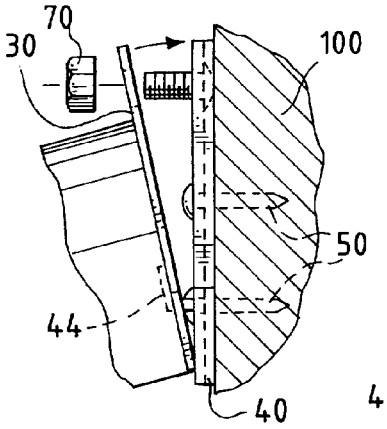
FIG. 4
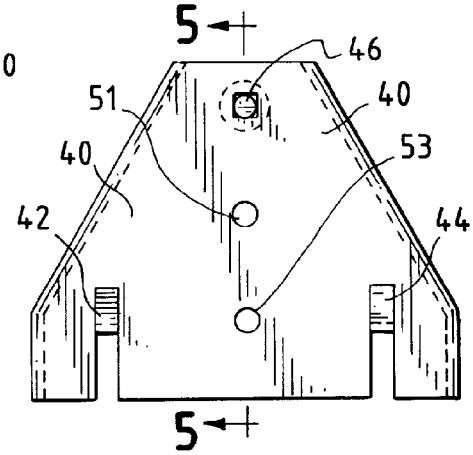
FIG. 5
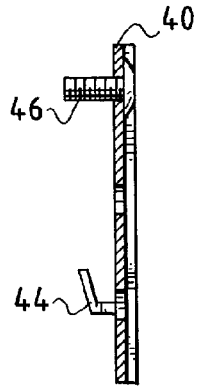
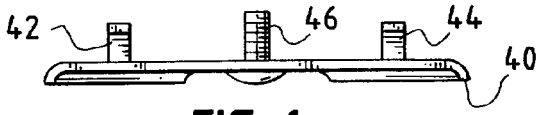
FIG. 6
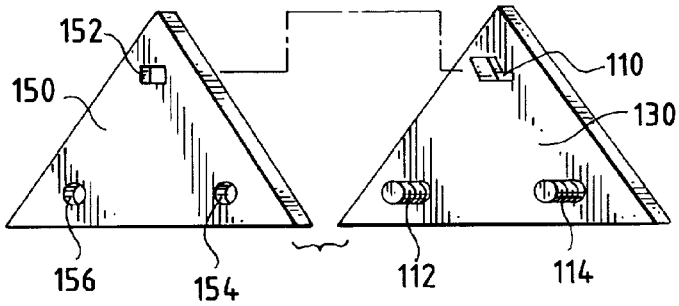
FIG. 7
FIG. 8
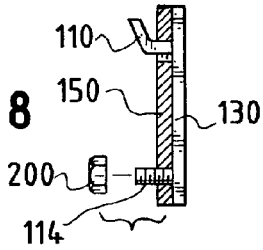

OUTDOOR LIGHT MOUNTING BRACKET

This application is a continuation of Ser. No. 09/320,257 filed on May 26, 1999 now abandoned.

BACKGROUND OF THE INVENTION

The invention relates to a novel device and method for securing an outdoor light fixture to a support surface. More particularly, the device and method of the present invention uses first and second supports to hold a light fixture to be installed in a temporary stable and secure position until a user fixedly installs the fixture through the use of fasteners and the like.

SUMMARY OF THE INVENTION

Outdoor light fixtures are often installed in locations that are only accessible by a ladder and which only permit a single person to install the fixture. Exacerbating the difficulty of installing a light fixture, current designs often require an installer to position a heavy fixture on a mounting plate with one hand while attempting to install up to three threaded fasteners with the other free hand. As may be imagined, there are a number of difficulties in performing this type of installation because the fixture is in an unstable position until the fasteners are employed. Thus, for increased ease of installation and safety, there is a need for a method and device that supports and stabilizes the light fixture prior to the installation of the more permanent installation fasteners and to minimize the number of fasteners used.

The present invention solves the above mentioned problems associated with the installation of a light fixture by providing a first support that is adapted to co-act with a second support so as to hold the light fixture in a stable and supported position until the light fixture is secured to the support surface in a more permanent relationship. This is accomplished by providing on one of the supports at least one catch that engages the opposing support so as to support the weight of the fixture in a stable position while fasteners are installed.

BRIEF DESCRIPTION OF THE DRAWINGS

FIG. 3 is a cross sectional view of a support used with the present invention;

FIG. 4 is a front view of the support;

FIG. 5 is a side view of the support shown in FIG. 4;

FIG. 6 is a top view of the support shown in FIG. 4;

FIG. 7 is an exploded perspective view of an alternate embodiment of the invention; and FIG. 8 is a side view of the embodiment shown in FIG. 7.

DESCRIPTION OF THE PREFERRED EMBODIMENT

Figure 1:
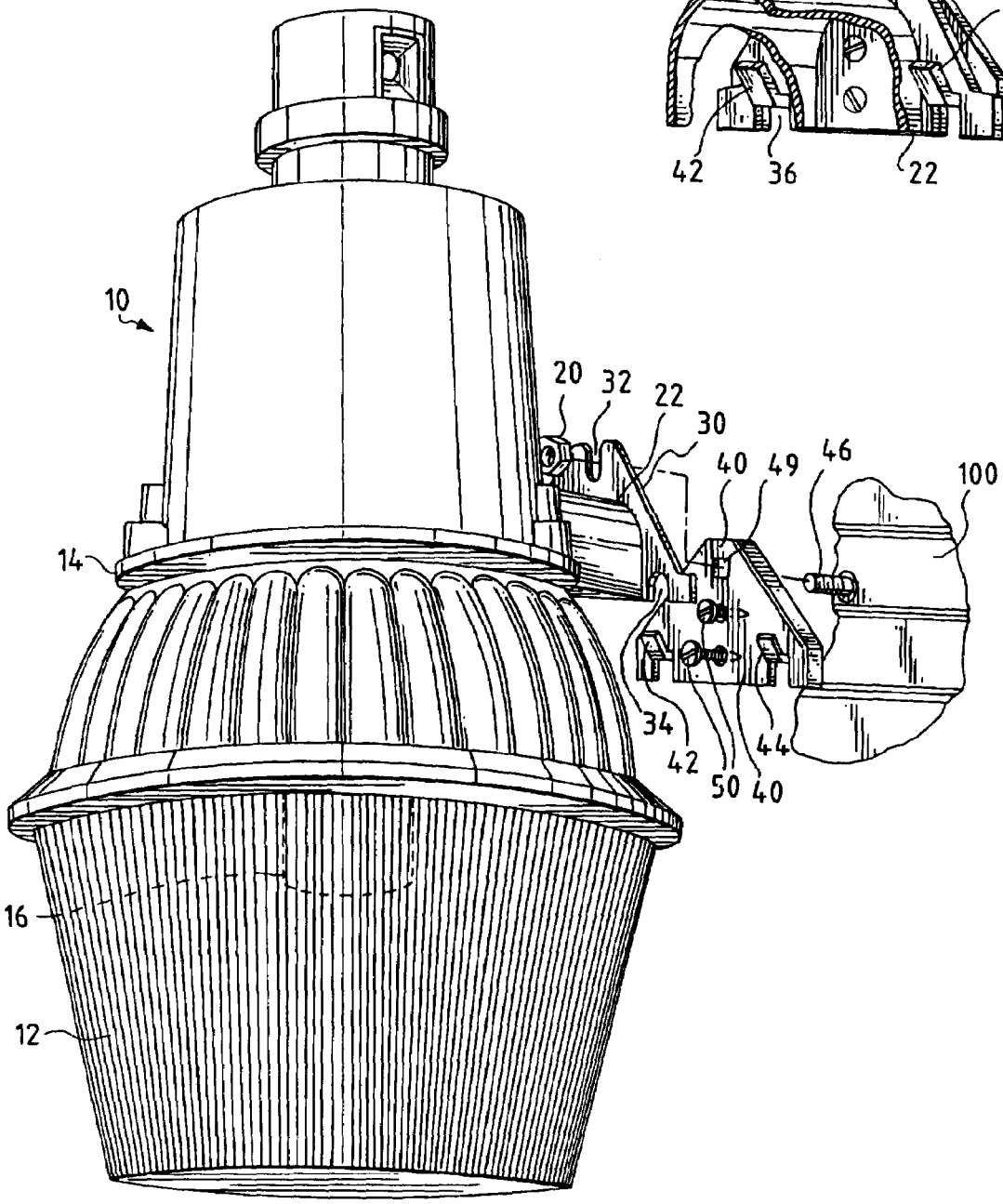
FIG. 1 is a perspective view of one embodiment of the present invention.

As shown in FIG. 1, the present invention is designed to work with a light fixture 10 having a lens 12 and a housing 14 which contains the wiring necessary to operate light source 16. Extending outwardly from fixture 10 is an arm 20 which has a distal end 22.

Figure 2:
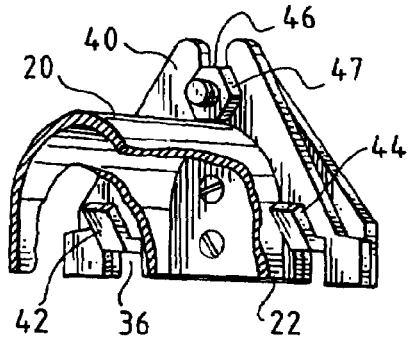
FIG. 2 is an exploded perspective view with portions removed to reveal aspects of the embodiment shown in FIG. 1.

As shown in FIGS. 1 and 2, located on distal end 22 is a first support 30 which is adapted to coact with a second support 40. As will be described in further detail below, supports 30 and 40 are adapted to support the weight of the fixture and to secure housing 10 in a stable position until the fixture may be more permanently secured to the support surface 100 by the installation of fasteners and the like.

As shown in FIGS. 1 and 2, support 30 is adapted to be affixed to housing 10, and as shown, it may be located on distal end 22 of arm 20. Support 30 may be integrally formed with and located on arm 20, on distal end 22, or on some other portion of housing 14. It would also be understood by those of skill in the art that support 30 may be affixed to light fixture 10 in other ways as well such as, without limitation, fasteners, welding, rivets and the like.

As shown in FIGS. 1 and 2, support 30 includes an aperture 32 and notches or cut-outs 34 and 36. As further shown, aperture 32 is located above notches 34 and 36 which are linearly aligned near the bottom of support 30. Aperture 32 and notches 34 and 36 are all sized and adapted to receive projections 42, 44 and 46 which may extend outwardly from support 40.

Projection 46 may be comprised of a fastener which has a threaded portion 47 sized to fit through aperture 49 of support 40. Projections 42 and 44, on the other hand, may be angled upwardly to form rests or stops which support 30 rests.

In use, support 40 is mounted to a support surface or an electrical junction box. As shown, this may be done by inserting fasteners 50 through apertures 51 and 53 and into the support surface. Prior to installing support 40, fastener 46 should be inserted through aperture 49. Of course, fastener 46 may also be integral with support 40 as well.

Once support 40 is installed, light fixture 10 is installed. To do this, a user places notches 32 and 34 onto projections 42 and 44, respectively. This engagement acts as a catch that stabilizes the fixture by using the projections to support the weight of the fixture. This places the fixture in a hands-free state in which the installer no longer needs to physically support the weight of the fixture on the support surface.

Next, as shown in FIG. 6 and while fixture 10 rests on the projections, fixture 10 is rotated upwardly until support 30 is in flush contact with support 40 and until fastener 46 extends through aperture 32. Fastener 70 is then installed which prevents the fixture from rotating downwardly, while the sized-fit between projections 42 and 44 with the square-like shaped cut-outs of apertures 32 and 34 prevent the downward, forward and sideways movement of the fixture.

As shown in FIGS. 7 and 8, in an alternate embodiment, a single, upwardly bent projection 110 and two threaded fastener projections 112 and 114 on plate 130 are shown. In use, plate 130 is first installed as was described above, then plate 150 which is located on the fixture in a positioned so that aperture 152 is placed over bent projection 110, and at the same time, fasteners 112 and 114 are placed through apertures 156 and 158. As described above, this places the fixture in a hands-free state in which the installer no longer needs to support the fixture on the support surface.

Next, with both free hands, the installer may use coacting fasteners 200 to more securely affix the fixture to the support surface.

As will be appreciated, this embodiment uses a single bent projection to act as a catch that supports the weight of the fixture and to hold the fixture in a stable, hands-free condition until more permanent fasteners may be installed.

While the preferred embodiments of the present invention have been illustrated and described, it will be understood by those of ordinary skill in the art that changes and other modifications can be made without departing from the invention in its broader aspects. Various features of the present invention are set forth in the following claims.

What is claimed is:

1. An assembly comprising:

a light fixture;

a first support member connected to the light fixture, the first support member defining a first planar surface and comprising first and second apertures;

a second support member adapted to be mounted to a vertical surface, the second support member defining a second planar surface and comprising:

a first projection comprising a distal end portion and extending from the second planar surface defined by the second support member and through the first aperture of the first support member, and a second projection extending from the second planar surface defined by the second support member and adapted to extend through the second aperture of the first support member; and a fastener adapted to engage the second projection of the second support member;

wherein the assembly comprises:

a first configuration in which:

at least a portion of the first planar surface defined by the first support member is angularly spaced from at least a portion of the second planar surface defined by the second support member, and the distal end portion of the first projection of the second support member engages the first support member to generally support the light fixture so that the light fixture is in a hands-free state; and a second configuration in which:

the at least a portion of the first planar surface defined by the first support member is in flush contact with the at least a portion of the second planar surface defined by the second support member, the second projection of the second support member extends through the second aperture of the first support member, and the fastener engages the second projection of the second support member to generally maintain the flush contact between the at least a portion of the first planar surface defined by the first support member and the at least a portion of the second planar surface defined by the second support member.

2. The assembly of claim 1 wherein the first support member defines a third planar surface spaced in a parallel relation from the first planar surface defined by the first support member; and wherein, when the assembly is in its first configuration, at least a portion of the distal end portion of the first projection of the second support member is in flush contact with at least a portion of the third planar surface defined by the first support member.

3. The assembly of claim 1 wherein the distal end portion of the first projection of the second support member is upwardly angled.

4. The assembly of claim 1 wherein, when the assembly is in its first configuration, the angular spacing between the at least a portion of the first planar surface defined by the first support member and the at least a portion of the second planar surface defined by the second support member defines a first angle; and wherein the distal end portion of the first projection of the second support member is upwardly angled so that a second angle is defined between the distal end portion of the first projection of the second support member and the second planar surface defined by the second support member; and wherein the first and second angles are substantially equal so that, when the assembly is in its first configuration, at least a portion of the distal end portion of the first projection of the second support member is in flush contact with at least a portion of a third planar surface defined by the first support member.

5. The assembly of claim 1 further comprising an arm connecting the first support member to the light fixture.

6. The assembly of claim 1 wherein the first support member further comprises at least one other aperture; and wherein the second support member comprises at least one other projection comprising a distal end portion and extending from the second planar surface defined by the second support member and through the at least one other aperture of the first support member.

7. The assembly of claim 6 wherein each of the first aperture, the second aperture, and the at least one other aperture is in the form of a notch; and wherein each respective distal end portion of the first projection of the second support member and the at least one other projection of the second support member is upwardly angled.

8. An assembly comprising:

a light fixture;

a first support member connected to the light fixture, the first support member defining a first planar surface and comprising first and second apertures; and a second support member adapted to be mounted to a vertical surface, the second support member defining a second planar surface and comprising:

a first projection comprising a distal end portion and extending from the second planar surface defined by the second support member and through the first aperture of the first support member, and a second projection extending from the second planar surface defined by the second support member and adapted to extend through the second aperture of the first support member;

wherein the assembly comprises:

a first configuration in which at least a portion of the first planar surface defined by the first support member is angularly spaced from at least a portion of the second planar surface defined by the second support member, and a second configuration in which:

the at least a portion of the first planar surface defined by the first support member is in flush contact with the at least a portion of the second planar surface defined by the second support member, and the second projection of the second support member extends through the second aperture of the first support member.

9. The assembly of claim 8 further comprising a fastener wherein, when the assembly is in its second configuration, the fastener engages the second projection of the second support member to generally maintain the flush contact between the at least a portion of the first planar surface defined by the first support member and the at least a portion of the second planar surface defined by the second support member.

10. The assembly of claim 8 wherein, when the assembly is in its first configuration, the distal end portion of the first projection of the second support member engages the first support member to generally support the light fixture so that the light fixture is in a hands-free state.

11. The assembly of claim 10 wherein the first support member defines a third planar surface spaced in a parallel relation from the first planar surface defined by the first support member; and wherein, when the assembly is in its first configuration, at least a portion of the distal end portion of the first projection of the second support member is in flush contact with at least a portion of the third planar surface defined by the first support member.

12. The assembly of claim 8 wherein the distal end portion of the first projection of the second support member is upwardly angled.

13. The assembly of claim 8 wherein, when the assembly is in its first configuration, the angular spacing between the at least a portion of the first planar surface defined by the first support member and the at least a portion of the second planar surface defined by the second support member defines a first angle; and wherein the distal end portion of the first projection of the second support member is upwardly angled so that a second angle is defined between the distal end portion of first projection of the second support member and the second planar surface defined by the second support member; and wherein the first and second angles are substantially equal so that, when the assembly is in its first configuration, at least a portion of the distal end portion of the first projection of the second support member is in flush contact with at least a portion of a third planar surface defined by the first support member.

14. The assembly of claim 8 further comprising an arm connecting the first support member to the light fixture.

15. The assembly of claim 8 wherein the first support member further comprises at least one other aperture; and wherein the second support member comprises at least one other projection comprising a distal end portion and extending from the second planar surface defined by the second support member and through the at least one other aperture of the first support member.

16. The assembly of claim 15 wherein each of the first aperture, the second aperture, and the at least one other aperture is in the form of a notch; and wherein each respective distal end portion of the first projection of the second support member and the at least one other projection of the second support member is upwardly angled.

17. An assembly comprising:

a light fixture;

a first support member connected to the light fixture, the first support member defining a first planar surface and comprising first and second apertures;

a second support member adapted to be mounted to a vertical surface, the second support member defining a second planar surface and comprising:

a first projection comprising a distal end portion and extending from the second planar surface defined by the second support member and through the first aperture of the first support member, and a second projection extending from the second planar surface defined by the second support member and adapted to extend through the second aperture of the first support member; and a fastener adapted to engage the second projection of the second support member;

wherein the assembly comprises:

a first configuration in which:

at least a portion of the first planar surface defined by the first support member is angularly spaced from at least a portion of the second planar surface defined by the second support member, and the distal end portion of the first projection of the second support member engages the first support member to generally support the light fixture so that the light fixture is in a hands-free state; and a second configuration in which:

the at least a portion of the first planar surface defined by the first support member is in flush contact with the at least a portion of the second planar surface defined by the second support member, the second projection of the second support member extends through the second aperture of the first support member, and the fastener engages the second projection of the second support member to generally maintain the flush contact between the at least a portion of the first planar surface defined by the first support member and the at least a portion of the second planar surface defined by the second support member;

wherein the distal end portion of the first projection of the second support member is upwardly angled;

wherein the first support member defines a third planar surface spaced in a parallel relation from the first planar surface defined by the first support member; and wherein, when the assembly is in its first configuration, at least a portion of the distal end portion of the first projection of the second support member is in flush contact with at least a portion of the third planar surface defined by the first support member.

18. The assembly of claim 17 wherein, when the assembly is in its first configuration, the angular spacing between the at least a portion of the first planar surface defined by the first support member and the at least a portion of the second planar surface defined by the second support member defines a first angle; and wherein the distal end portion of the first projection of the second support member is upwardly angled so that a second angle is defined between the distal end portion of the first projection of the second support member and the second planar surface defined by the second support member; and wherein the first and second angles are substantially equal to permit the at least a portion of the distal end portion of the first projection of the second support member to be in flush contact with the at least a portion of the third planar surface defined by the first support member when the assembly is in its first configuration.

19. The assembly of claim 17 further comprising an arm connecting the first support member to the light fixture.

20. The assembly of claim 17 wherein the first support member further comprises at least one other aperture; and wherein the second support member comprises at least one other projection comprising a distal end portion and extending from the second planar surface defined by the second support member and through the at least one other aperture of the first support member.

21. The assembly of claim 20 wherein each of the first aperture, the second aperture, and the at least one other aperture is in the form of a notch; and wherein each respective distal end portion of the first projection of the second support member and the at least one other projection of the second support member is upwardly angled.

22. A method of mounting a light fixture to a vertical surface comprising:

connecting a first support member to a light fixture;

mounting a second support member to a vertical surface;

positioning the first support member so that at least a portion of a first planar surface defined by the first support member is angularly spaced from at least a portion of a second planar surface defined by the second support member;

placing the at least a portion of the first planar surface in flush contact with the at least portion of the second planar surface;

maintaining the flush contact between the at least a portion of the first planar surface and the at least portion of the second planar surface; and supporting the light fixture so that the light fixture is in a hands-free state by engaging the first support member with an upwardly-angled distal end portion of a first projection extending from the second planar surface and through an aperture in the first support member.

23. The method of claim 22 wherein a first angle is defined between the at least a portion of the first planar surface and the at least a portion of the second planar surface in response to positioning the first support member so that the at least a portion of the first planar surface is angularly spaced from the at least a portion of the second planar surface;

wherein a second angle is defined between the upwardly-angled distal end portion of the first projection and the at least a portion of the second planar surface; and wherein the first and second angles are substantially equal.

24. The method of claim 22 wherein supporting the light fixture so that the light fixture is in a hands-free state comprises:

placing at least a portion of an upwardly-angled distal end portion of a first projection extending from the second planar surface and through an aperture in the first support member in flush contact with at least a portion of a third planar surface defined by the first support member and spaced in a parallel relation from the first planar surface.

25. A method of mounting a light fixture to a vertical surface comprising:

connecting a first support member to a light fixture, the first support member defining a first planar surface;

mounting a second support member to a vertical surface, the second support member defining a second planar surface;

positioning the first support member so that at least a portion of the first planar surface defined by the first support member is angularly spaced from at least a portion of the second planar surface defined by the second support member;

supporting the light fixture so that the light fixture is in a hands-free state, wherein supporting the light fixture so that the light fixture is in a hands-free state comprises:

placing at least a portion of an upwardly-angled distal end portion of a first projection extending from the second planar surface defined by the second support member and through an aperture in the first support member in flush contact with at least a portion of a third planar surface defined by the first support member and spaced in a parallel relation from the first planar surface defined by the first support member;

placing the at least a portion of the first planar surface defined by the first support member in flush contact with the at least portion of the second planar surface defined by the second support member; and maintaining the flush contact between the at least a portion of the first planar surface defined by the first support member in flush contact and the at least portion of the second planar surface defined by the second support member;

wherein a first angle is defined between the at least a portion of the first planar surface defined by the first support member and the at least a portion of the second planar surface defined by the second support member in response to positioning the first support member so that the at least a portion of the first planar surface defined by the first support member is angularly spaced from the at least a portion of the second planar surface defined by the second support member;

wherein a second angle is defined between the upwardly-angled distal end portion of the first projection extending from the second planar surface defined by the second support member and through the aperture in the first support member and the at least a portion of the second planar surface defined by the second support member; and wherein the first and second angles are substantially equal.

26. A system comprising:

means for connecting a first support member to a light fixture;

means for mounting a second support member to a vertical surface;

means for positioning the first support member so that at least a portion of a first planar surface defined by the first support member is angularly spaced from at least a portion of a second planar surface defined by the second support member;

means for placing the at least a portion of the first planar surface in flush contact with the at least portion of the second planar surface; and means for maintaining the flush contact between the at least a portion of the first planar surface and the at least portion of the second planar surface.

27. The system of claim 26 further comprising:

means for supporting the light fixture so that the light fixture is in a hands-free state.

28. The system of claim 27 wherein the means for supporting the light fixture so that the light fixture is in a hands-free state comprises:

means for engaging the first support member with an upwardly-angled distal end portion of a first projection extending from the second planar surface and through an aperture in the first support member.

29. The system of claim 28 wherein a first angle is defined between the at least a portion of the first planar surface and the at least a portion of the second planar surface when the first support member is positioned so that the at least a portion of the first planar surface is angularly spaced from the at least a portion of the second planar surface;

wherein a second angle is defined between the upwardly-angled distal end portion of the first projection and the at least a portion of the second planar surface; and wherein the first and second angles are substantially equal.

30. The system of claim 27 wherein the means for supporting the light fixture so that the light fixture is in a hands-free state comprises:

means for placing at least a portion of an upwardly-angled distal end portion of a first projection extending from the second planar surface and through an aperture in the first support member in flush contact with at least a portion of a third planar surface defined by the first support member and spaced in a parallel relation from the first planar surface defined by the first support member.

31. A system comprising:

means for connecting a first support member to a light fixture, the first support member defining a first planar surface;

means for mounting a second support member to a vertical surface, the second support member defining a second planar surface;

means for positioning the first support member so that at least a portion of the first planar surface defined by the first support member is angularly spaced from at least a portion of the second planar surface defined by the second support member;

means for supporting the light fixture so that the light fixture is in a hands-free state, wherein the means for supporting the light fixture so that the light fixture is in a hands-free state comprises:

means for placing at least a portion of an upwardly-angled distal end portion of a first projection extending from the second planar surface defined by the second support member and through an aperture in the first support member in flush contact with at least a portion of a third planar surface defined by the first support member and spaced in a parallel relation from the first planar surface defined by the first support member; means for placing the at least a portion of the first planar surface defined by the first support member in flush contact with the at least portion of the second planar surface defined by the second support member; and means for maintaining the flush contact between the at least a portion of the first planar surface defined by the first support member in flush contact and the at least portion of the second planar surface defined by the second support member;

wherein a first angle is defined between the at least a portion of the first planar surface defined by the first support member and the at least a portion of the second planar surface defined by the second support member when the first support member is positioned so that the at least a portion of the first planar surface defined by the first support member is angularly spaced from the at least a portion of the second planar surface defined by the second support member;

wherein a second angle is defined between the upwardly-angled distal end portion of the first projection extending from the second planar surface defined by the second support member and through the aperture in the first support member and the at least a portion of the second planar surface defined by the second support member; and wherein the first and second angles are substantially equal.

* * * * *